United States Patent [19]

Lewis

[11] Patent Number: 4,630,026

[45] Date of Patent: Dec. 16, 1986

[54] ELEVATOR POSITION INDICATING SYSTEM

[75] Inventor: Michael D. Lewis, East Moline, Ill.

[73] Assignee: Montgomery Elevator Company, Moline, Ill.

[21] Appl. No.: 480,024

[22] Filed: Mar. 29, 1983

[51] Int. Cl.[4] ..... B66B 3/02

[52] U.S. Cl. ..... 340/21; 340/825.62

[58] Field of Search ..... 340/19 R, 20, 21, 825.62; 370/77

[56] References Cited

U.S. PATENT DOCUMENTS

| | | | |
|---|---|---|---|
| 3,807,531 | 4/1974 | Mandel | 340/19 R X |
| 3,967,700 | 7/1976 | Tur et al. | 340/21 X |
| 3,995,719 | 12/1976 | Mandel et al. | 340/19 R |
| 4,032,882 | 6/1977 | Mandel et al. | 340/21 X |
| 4,157,133 | 6/1979 | Corcoran et al. | 340/19 R X |
| 4,245,212 | 1/1981 | Crimele | 340/825.62 X |
| 4,427,095 | 1/1984 | Payne et al. | 340/21 X |
| 4,436,185 | 3/1984 | Ludwig et al. | 340/21 X |

OTHER PUBLICATIONS

Commutat & Transm., vol. 3, No. 1, pp. 37–52, "4×TN4 Digital Traffic for Existing Coaxial Plant".

*Primary Examiner*—John W. Caldwell, Sr.
*Assistant Examiner*—Tyrone Queen
*Attorney, Agent, or Firm*—Wood,Dalton,Phillips,Mason & Rowe

[57] ABSTRACT

A position indicating system for an elevator system includes a position indicator which operates in conjunction with an elevator control to provide an indication of elevator position and direction of travel by means of a display disposed within the elevator or at any position in the building. The position of the elevator is sensed by the elevator control and is converted into a multi-bit digital word which is transmitted serially over hoistway wires to the position indicator. The position indicator utilizes the multi-bit word to access a memory in which is stored a library of codes for character sets which may be indicated by the display. The proper codes are obtained from the memory and used to energize the display elements to illuminate the desired characters. By transmitting the position word in serial fashion to the position indicator, only six hoistway wires are required regardless of the number of position indicators utilized in the building. Further, a standardized library may be stored in the memory element, in turn permitting the position indicator to be mass produced.

13 Claims, 10 Drawing Figures

ELEVATOR POSITION INDICATING SYSTEM

BACKGROUND OF THE INVENTION

The present invention relates generally to indicating devices and more particularly to an elevator position indicating system which is capable of displaying position information and other information to an occupant of the elevator car.

A prior elevator indicating system, disclosed in Mandel et al. U.S. Pat. No. 3,995,719, includes a position indicator having a display operated in conjunction with an elevator control which detects the position of an elevator car in a hoistway and generates a binary signal representing the position of the elevator car. The binary signals are transmitted to the display located in the elevator car which in turn provides an indication of elevator car location.

One disadvantage of the above-noted system is that the binary signals are sent in parallel form to the display in the elevator car, thereby requiring separate conductors for each bit of the binary signal. This in turn requires a large number of hoistway wires, thereby increasing the cost and complexity of the system.

A further disadvantage is that the elevator control generates a standardized binary signal for each floor of a building regardless of the indication to be generated for that floor, e.g. the elevator control generates a particular signal for the first floor of a building irrespective of whether the display is to indicate a "1" (for the first floor) or "L" (for lobby). This type of system therefore requires that the position indicator be custom programmed so that the position indicator can be used in a particular installation. This programming is in addition to the programming required for the elevator control, thereby requiring customization of both the elevator control and the position indicator and further complicating the task of installing such a system.

SUMMARY OF THE INVENTION

The elevator position indicating system of the present invention avoids the above-noted disadvantages by utilizing a memory in a position indicator in which is stored a standard library of character sets, any one set of which can be indicated by a display for each floor of a building. The choice as to the particular character set to be displayed for each floor is dependent only upon the programming of an elevator control which is programmed to develop a particular multi-bit binary signal for each sensed elevator position. Consequently, the position indicator may be mass-produced. Further, the binary signal representation is sent in serial form from the elevator control to the position indicator, thereby leading to a reduction in hoistway wires, in turn reducing the complexity and expense of the system.

The position indicator which forms a part of the present invention includes a serial to parallel converter which reconstructs the multi-bit signal. The reconstructed information is then used to access a first look up table to retrieve a character code representing the character set to be indicated by a display. The character code is then used to access a second look up table to obtain a set of display codes required to form the characters on a display. In the preferred embodiment, the display is of the dot matrix type having three display elements which are energized one row at a time in accordance with the display codes to indicate the position of the elevator in the hoistway.

The position indicating system may alternatively be programmed to display other types of information owing to the ability of the dot matrix display to represent various types of alpha-numeric characters.

DESCRIPTION OF THE PREFERRED EMBODIMENT

Figure 1:
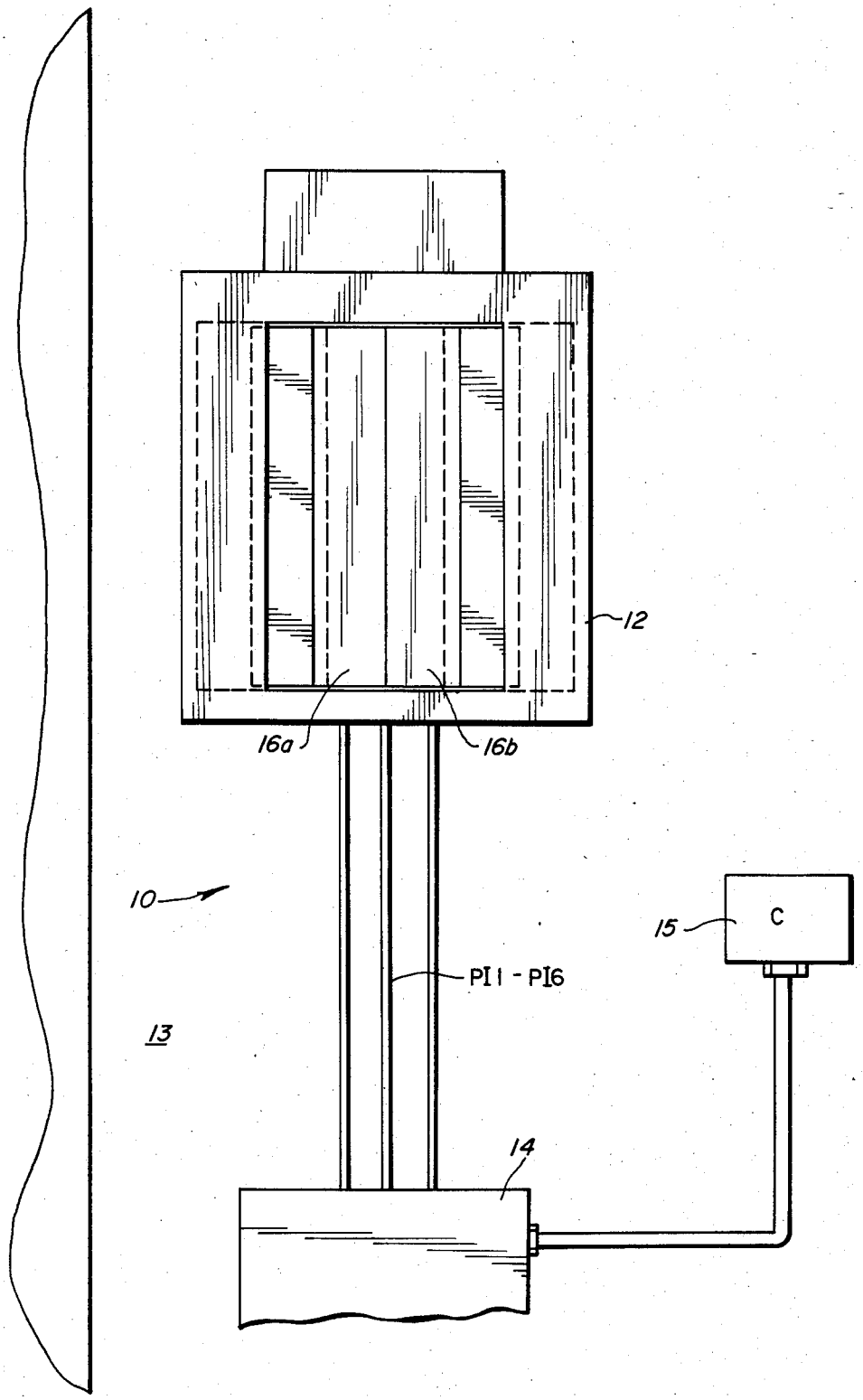
FIG. 1 is an elevational view of an elevator in a hoistway.

Referring to FIG. 1, there is illustrated an elevator system 10 comprising an elevator car 12 which is movable within a hoistway 13 by means of a prime mover 14. The prime mover 14 moves the car 12 in response to commands from an elevator control 15, such as the control shown in Bril U.S. Pat. No. 4,246,983, the disclosure of which is hereby incorporated by reference. The elevator car 12 in the illustrated embodiment includes a pair of doors **16*a*,16*b* which are controlled by the elevator control 15**, as noted more particularly below. Other types of door arrangements may be used.

While the description herein is in reference to an automatic passenger elevator, it should be understood that the invention may be used with other types of systems, such as a freight elevator.

Figure 2:
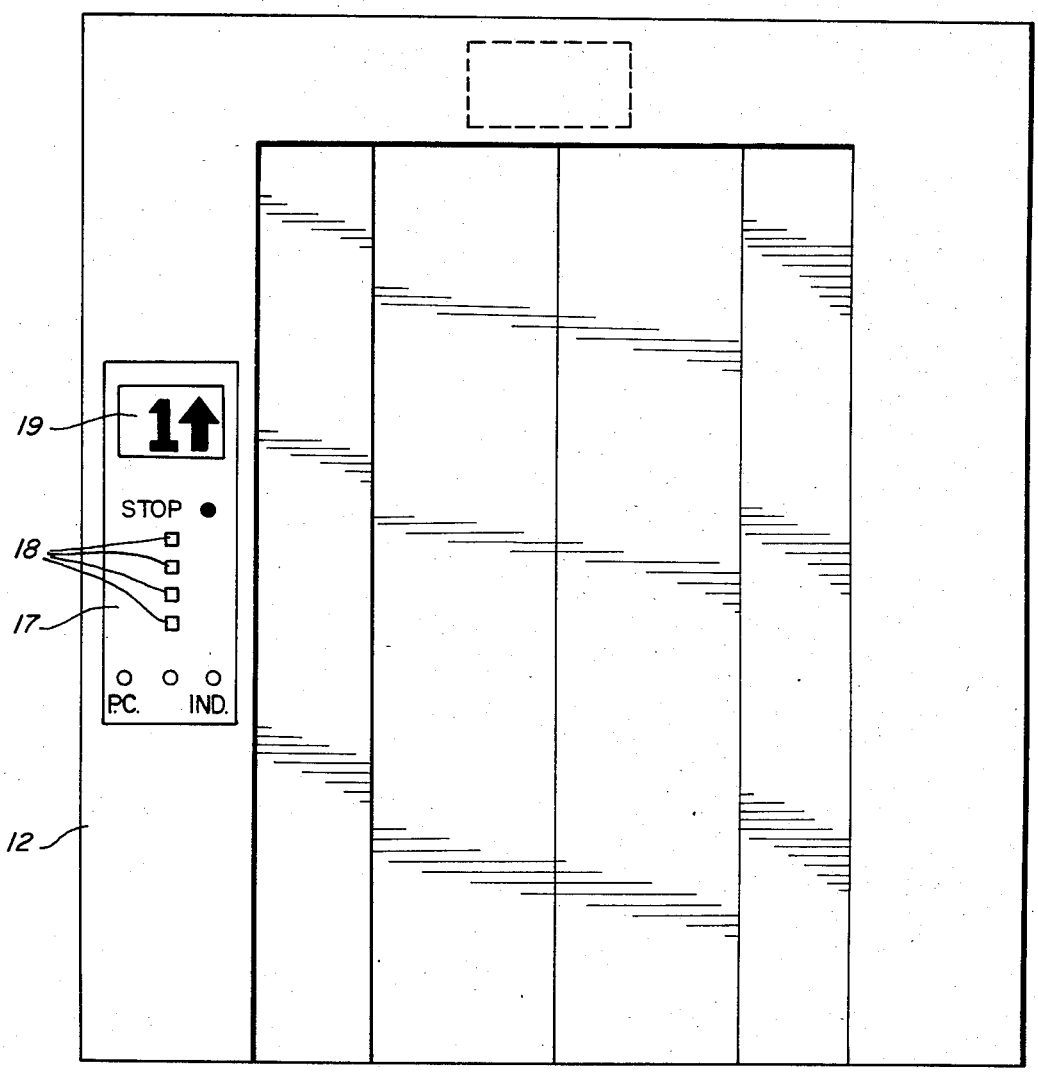
FIG. 2 is an elevational view of the interior of the elevator shown in FIG. 1 showing the display of the position indicator of the present invention.

Referring now to FIG. 2, a car return panel 17 is mounted on an inner wall of the elevator car 12 and includes the necessary car call buttons 18 by which a passenger may select the floor to which he desires to travel.

Also disposed within the car return panel 17 is an indicator display 19 which indicates the current position of the elevator car 12 in the hoistway 13. It should be noted that the indicator display 19 may alternatively be disposed within the transom of the elevator car 12, as indicated by the dashed lines.

Figure 3A:
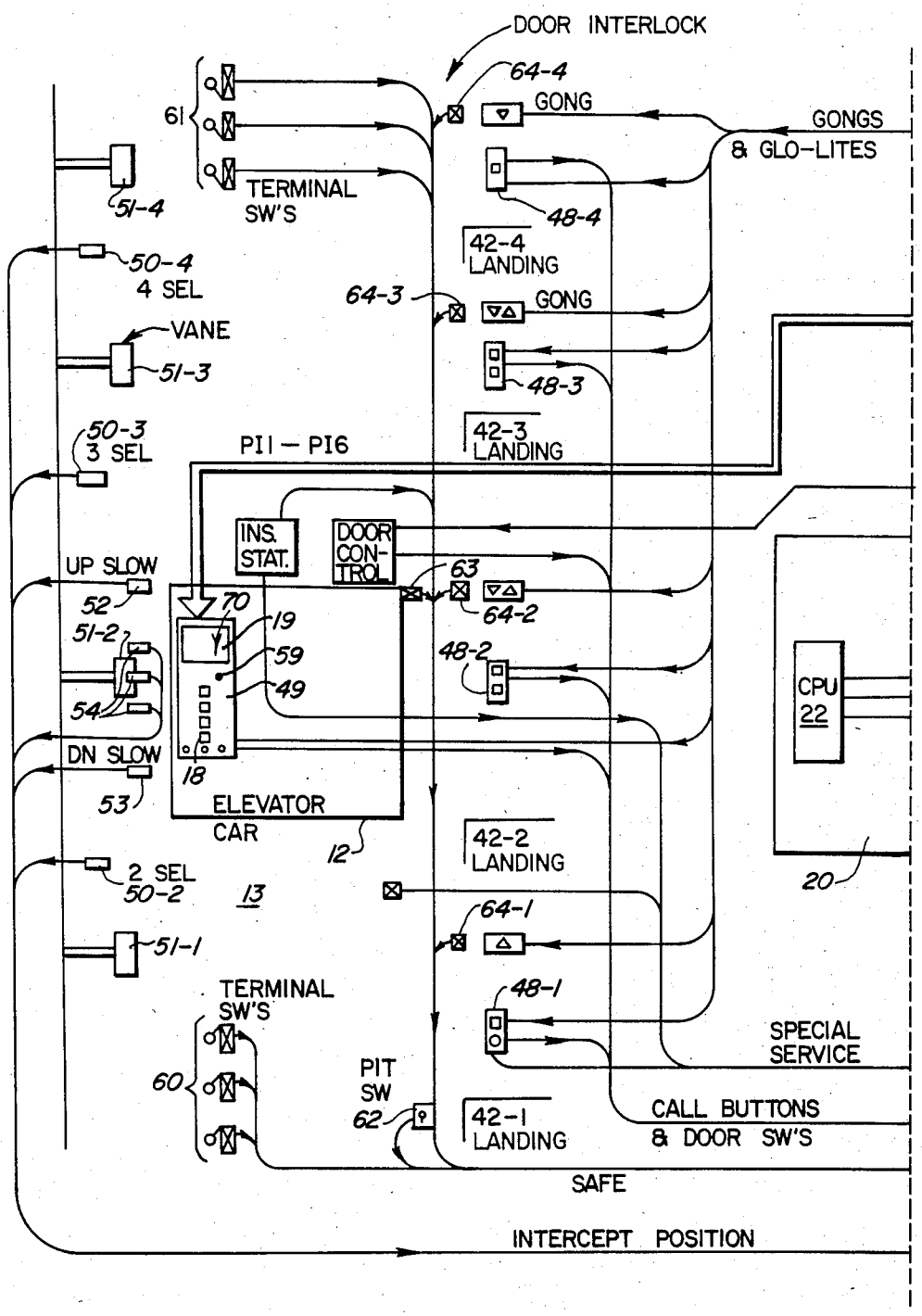
FIGS. 3A and 3B, when joined along the dashed lines, together comprise a block diagram of an elevator control in conjunction with the position indicator of the present invention.
Figure 3B:
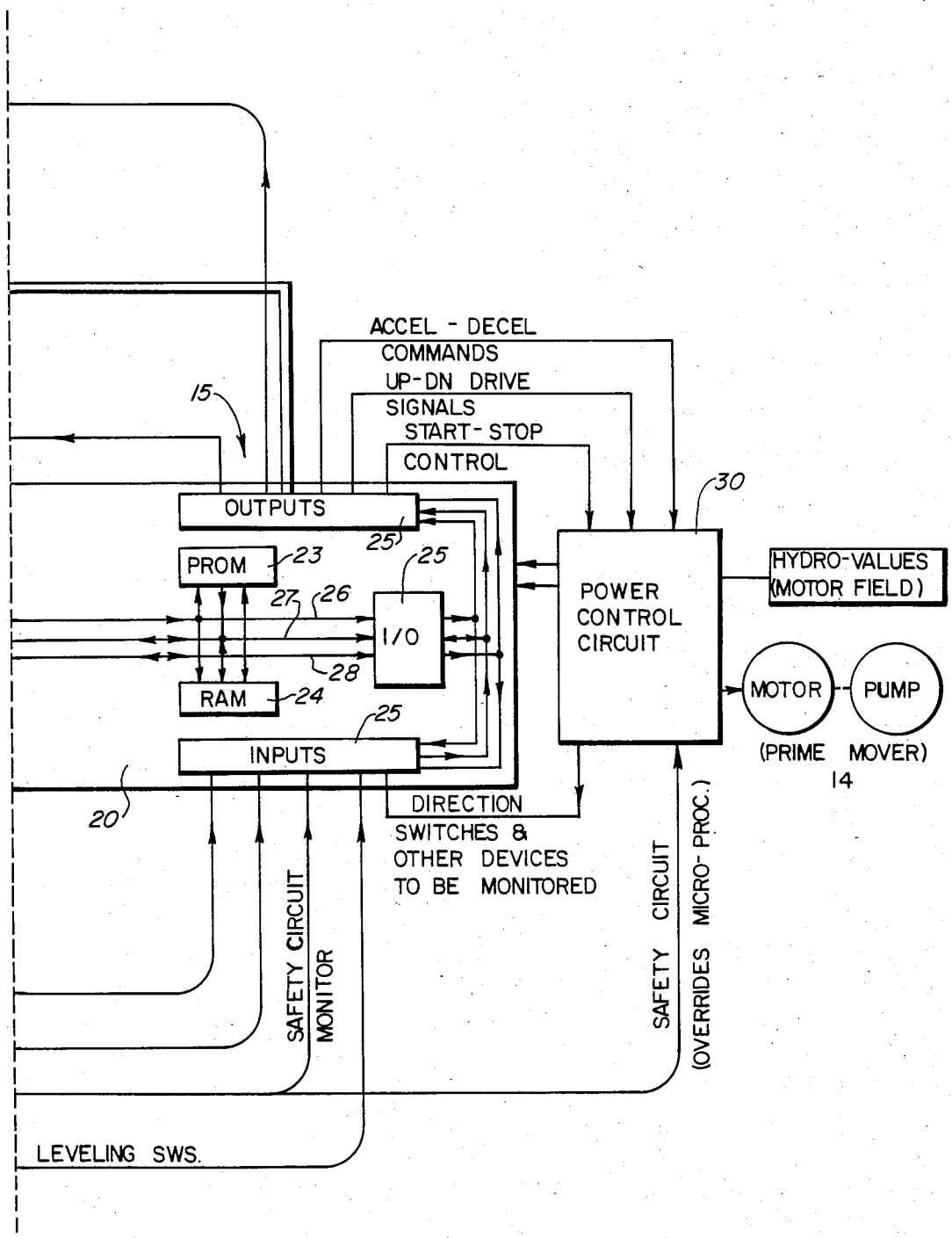

Referring now to FIGS. 3A and 3B, the elevator control 15 includes a microprocessor 20 having a central processing unit or CPU 22, a programmable read-only memory or PROM 23, a random access memory or RAM 24, and a plurality of input/output circuits or I/O circuits 25. The control program for the elevator control is stored in the PROM 23 wile intermediate results and flags are stored in registers in the RAM 24. The I/O circuits 25 sense various operating parameters for the elevator and control output devices as noted more specifically below. The CPU 22 communicates with the PROM 23, RAM 24 and I/O circuits 25 through an address bus 26, a data bus 27 and a control bus 28.

The elevator control illustrated is for a single elevator car, sometimes termed a Simplex system. However, it should be understood that the elevator control shown in FIGS. 3A and 3B may also be used in a two car (duplex) or plural car (multiplex) system, in which case each elevator would include a display 19.

As shown specifically in FIG. 3B, main line power for the microprocessor 20 is provided by a power control circuit 30 which receives electrical power from three-phase power lines (not shown). The power control circuit 30 controls the prime mover 14 in response to signals from the microprocessor 20, as noted more specifically in Bril U.S. Pat. No. 4,246,983.

The elevator car 12 serves a plurality of landings or floors 42-1,42-2,42-3,42-4. Elevator service demand is indicated by the registration of hall or car calls through the actuation of hall call switches 48-1, 48-2,48-3,48-4 at each landing 42. There are up and down call switches at intermediate floors, an up call switch at the lowest floor and a down call switch at the highest floor. Elevator service demand may be alternatively indicated by the registration of the car call buttons 18, as previously noted.

The position of the elevator car 12 in the hatchway 13 is detected by sensors 50-2,50-3,50-4 located adjacent the path of the car and actuated by the presence thereof. Vanes 51-1,51-2,51-3,51-4 are located in the hatchway 13 for each landing. Vane sensors 52,53 on the elevator car provide a car position signal relative to the vane for initiating a slow down upon the interception of a vane at a floor where the car is to stop. Levelling sensors 54 respond to the floor vanes 51-1,51-2,51-3,51-4 to control the prime mover 14, bringing elevator car 12 to a stop in alignment with the landing.

Safety signal sources are connected both to the input circuit 25 of the elevator control and to the power control circuit 30 to cause an override of the control in the event of a malfunction or dangerous condition. Safety inputs include a manual stop switch 59 on the elevator car, a series of terminal switches 60,61 limiting the car travel at the first and fourth landings, resepectively, and a pit switch 62 which provides a further safety limiting descent below landing 42-1. A door interlock 63 is provided for the doors 16 on the elevator car 12 and individual door interlocks 64-1,64-2,64-3,64-4 are provided for the doors at each of the landings. The car should not run unless all doors are closed.

Output signals from the elevator control light the car and hall call buttons to indicate the registration of service calls and actuate gongs (which may also be lighted) at each landing to indicate car direction of travel. Output signals from the elevator control also actuate a position indicator 70, of which the indicator display 19 is a part, which is disposed behind the car return panel 17 in the elevator car 12. An additional position indicator may be disposed at the home landing 42-1 or any other location in the building to indicate the current position of the elevator car 12, if desired.

The microprocessor 20 is coupled to the position indicator 70 over six hoistway wires PI1–PI6. Three of these wires PI1–PI3 are utilized in connection with the transmission of position information and the remaining three wires PI4–PI6 supply power to the position indicator 70.

Figure 4A:
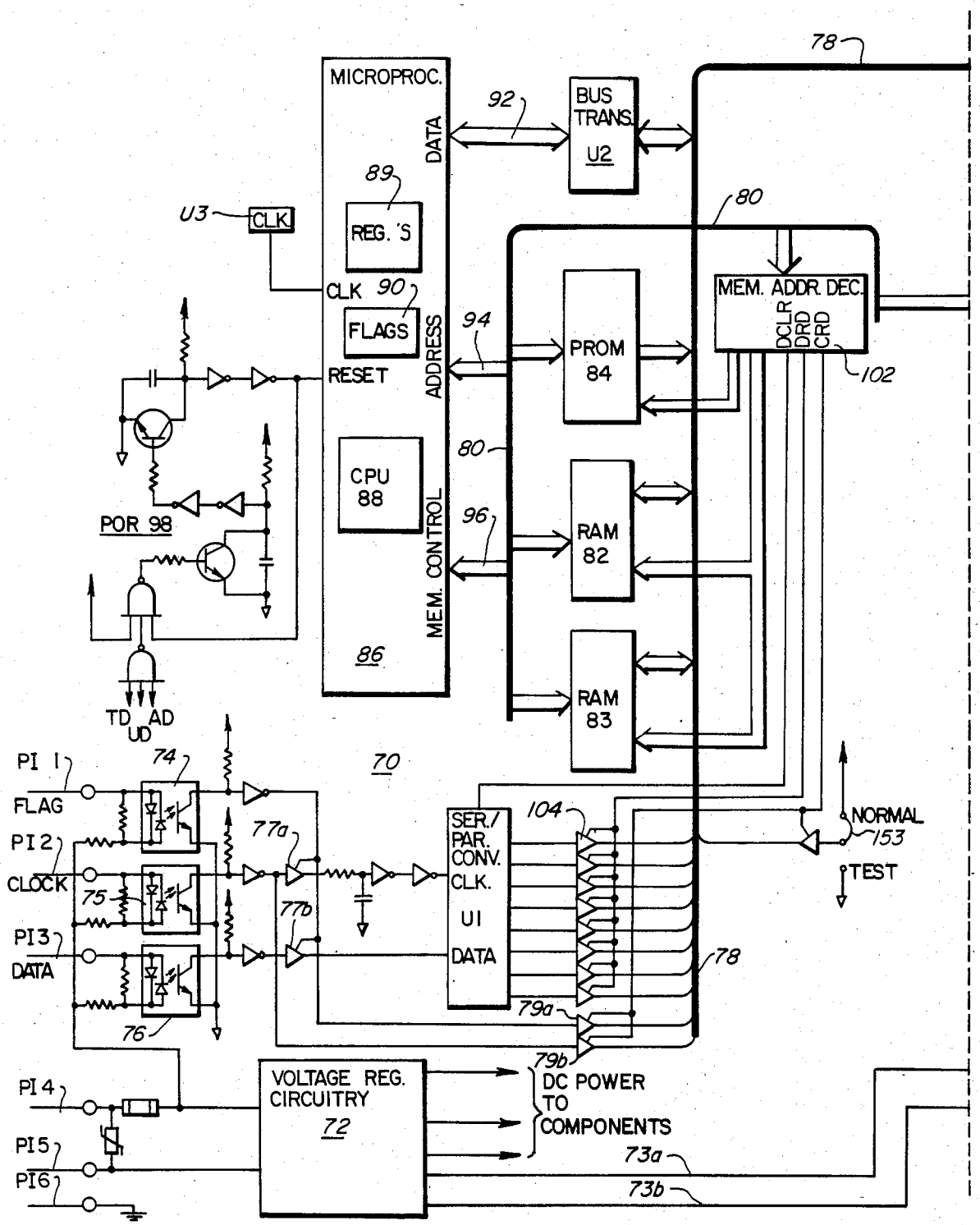
FIGS. 4A and 4B, when joined along the dashed lines, together comprise a schematic diagram of the position indicator shown in block diagram form in FIG. 3A.
Figure 4B:
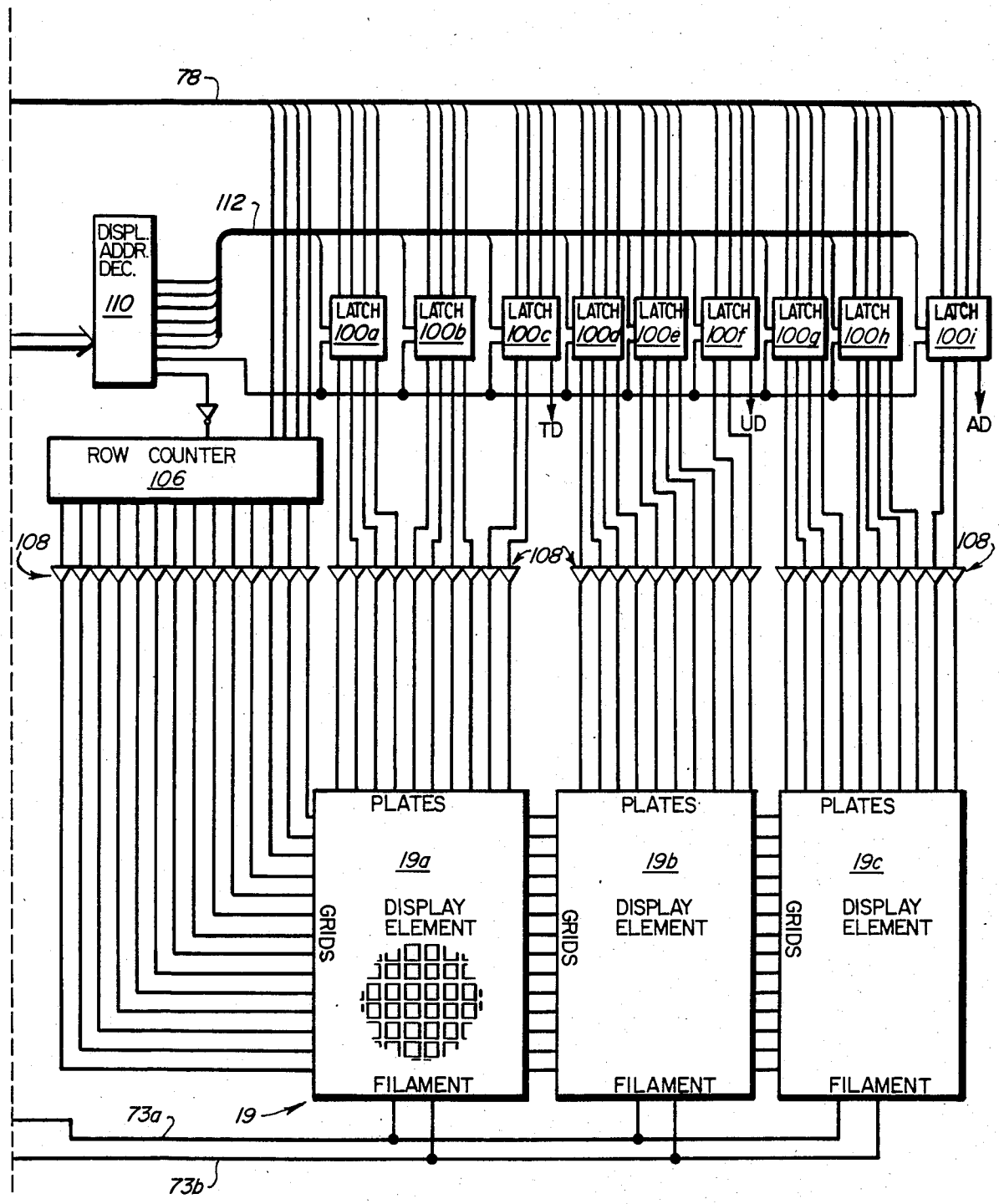

Referring now to FIGS. 4A and 4B, the hoistway wires PI4,PI5 are coupled to voltage regulating circuitry 72 to produce operating voltages for the various integrated circuits and components shown in FIGS. 4A and 4B. The circuitry 72 also produces an AC voltage over lines **73*a*,73*b* which is coupled to the indicator display 19 shown in FIG. 4B**. in addition, the hoistway wire PI6 provides a reference at ground potential.

The hoistway wires PI1,PI2,PI3, FIG. 4A, transmit flag, clock and data signals, respectively, to three optical isolators 74,75,76. The flag, clock and data signals are 120 volt AC signals to minimize the effects of noise in the system. The flag, clock and data signals are considered to be in a one state when 120 volts AC is present on the hoistway wires PI1, PI2 and PI3, respectively, and are considered to be in a zero state when substantially zero volts AC is on these lines. The isolators 74–76 convert the 120 volt AC signals on these lines into 5 volt DC signals for use by the components of the position indicator. The clock and data signals are coupled to a serial to parallel converter U1 through tri-state buffers **77*a*,77*b*. The signal representing the position of the elevator car 12 in the hoistway 13 is transmitted in a serial fashion over the data line PI3 and is clocked into the serial to parallel converter U1 by the clock signal on the line PI2. The flag and clock signals are also coupled to a first bus 78 through tri-state buffers 79*a*, 79*b*** for transmission to other components of the system as will be described in greater detail hereinafter.

Also coupled to the bus 78 and to a second bus 80 are a pair of random access memories or RAM 82,83 and a programmable read-only memory or PROM 84. These memory elements serve as external memory for a position indicator microprocessor 86 which contains an internal CPU 88 and internal memory for registers 89 and flags 90 used during the execution of a control program stored in the PROM 84.

The PROM 84 also stores a standard library of codes for energizing the display 19 so that it indicates any one of a plurality of characters. In the preferred embodiment, the PROM 84 stores sufficient codes to represent up to 64 character sets on the display 19.

A set of data lines 92 for the position indicator microprocessor 86 communicate with the first bus 78 through a bus transceiver U2. A set of address lines 94 and a set of memory control lines 96 of the microprocessor 86 comprise the second bus 80. The microprocessor 86 also receives a signal from clock circuitry U3 and a signal from a power-on-reset circuit 98. The clock circuitry controls the internal timing of the microprocessor 86 while the POR circuit 98 monitors the continuous operation of the displays and resets the microprocessor 86 in the event of a malfunction or loss of power. The POR circuit 98 in turn receives inputs, deignated TD,UD-,AD, from three of a series of latches **100*a*–100*i*, shown in FIG. 4B. During normal operation of the position indicator, the signals TD,UD,AD are constantly toggling on and off. When, however, the toggling action ceases, such as when a power interruption occurs, the POR circuit 98 develops a signal which is coupled to the microprocessor 86** to cause reinitialization thereof.

A memory address decoder 102 is coupled to the second bus 80 to control the addressing of the RAM's 82,83 and the PROM 84. Further, the memory address decoder 102 includes three outputs, designated DCLR, DRD and CRD, which are used to clear the serial to parallel converter U1, output the data from the converter U1 through a series of tri-state buffers and output the flag and clock data on the lines PI1,PI2 to the bus 78 through the tri-state buffers 79a,79b, respectively.

A row counter 106, FIG. 4B, includes fourteen outputs which are coupled through level shifters 108 to the grid inputs of each of three display elements 19a–19c which together comprise the indicator display 19. The latches 100a–100i are also coupled through the level shifters 108 to the plate circuits of the display elements 19a–19c. The filaments of the display elements 19a–19c are coupled to the lines 73a,73b to receive the AC voltage from the voltage regulator 72.

In the preferred embodiment, the display elements 19a,19b are energized to indicate floor position while the display element 19c is utilized to indicate an up or down arrow indicating the direction of travel of the elevator car 12. Further, the display elements 19a–19c are 10×14 vacuum fluorescent displays of the dot matrix type wherein each individual light emitting element or dot is energized when a voltage of approximately 40 volts DC is coupled to each of the corresponding plate and grid circuits while an AC voltage of 2.5 volts is delivered to the filament circuit.

The row counter 106 and the latches 100a–100i are controlled by a display address decoder 110 which is coupled to the second bus 80, a third bus 112 and to a clear input for each of the latches 100a–100i. The third bus 112 is coupled to a clock input of each of the latches 100a–100i.

Figure 5:
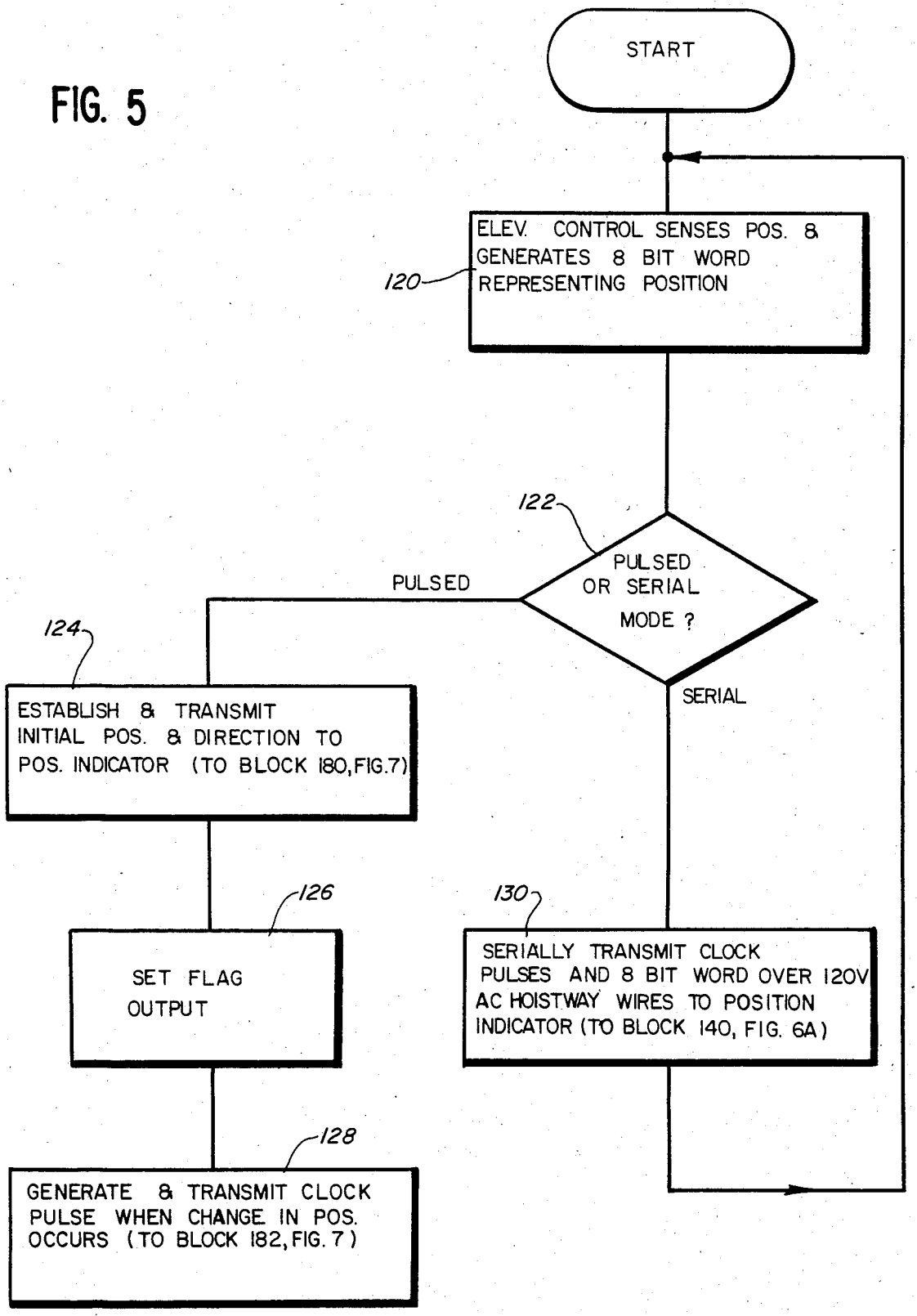
FIG. 5 is a flow chart of the program executed by the elevator control microcomputer shown in FIGS. 3A and 3B.

Referring now to FIG. 5, there is illustrated a portion of the control program stored in the PROM 23 of the microprocessor 20 shown in FIGS. 3A and 3B. This portion of the control program for the microprocessor 20 is in addition to the programming required for control of the elevator car 12 by the control 15.

A block 120 monitors the sensors 50-2,50-3,50-4 to determine the current position of the elevator car 12 in the hoistway 13. The block 120 then generates a multi-bit digital word representing the position of the elevator car.

The particular multi-bit word generated for each floor of a building is dependent upon the programming of the microprocessor 20, and is selected to recall from the PROM 84 the proper codes for display of the desired character set on the display 19. In the preferred embodiment, the multi-bit word includes eight-bits, with the two most significant bits representing the direction of travel of the elevator and the remaining 6 bits representing the current position of the car 12.

A block 122 then determines whether the elevator control 15 has been programmed to operate in one of two operational modes, designated serial mode or pulsed mode. Generally, the pulsed mode is used in those installations where elevator speed exceeds 750 fpm (feet per minute) while the serial mode is used in installations operating at slower speeds. In general, the elevator control microprocessor 20 is programmed for one of these two modes of operation prior to installation and is not a field selectable option.

If the elevator control is operating in the pulsed mode, a block 124 establishes the initial position and desired direction of operation of the elevator car 12 and forms a unique 8-bit word representing this information. The initial position is that position assumed by the elevator car 12 when the elevator control 15 is first powered up or any time the car 12 changes direction of travel. The 8-bit word is then converted to a 120 volt AC signal and is transmitted in serial form over the hoistway wire PI3 along with clock pulses over the wire PI2 to the position indicator 70.

A block 126 then generates a signal on the hoistway wire PI1, which informs the position indicator 70 that it is to operate in the pulsed mode. A block 128 generates and transmits a floor-change pulse over the hoistway wire PI2 when a change in elevator car position occurs.

As will be explained in greater detail hereinafter, the position indicator stores the initial position and direction of the elevator car, displays this position and increments or decrements the displayed position based on initial direction by one when a valid floor-change pulse is received from the elevator control over the hoistway wire PI2.

If the block 122 determines that the elevator control is in the serial mode, the 8-bit word formed by the block 120 is serially transmitted by a block 130 along with clock pulses over the 120 volt AC hoistway wires PI2 and PI3 to the position indicator. The block 130 transmits the 8-bit word one bit at a time simultaneously with a clock pulse which indicates when a valid piece of data is to be read by the position indicator. Control from this block then returns to the block 120 where the elevator control redetermines the elevator position.

Figure 6A:
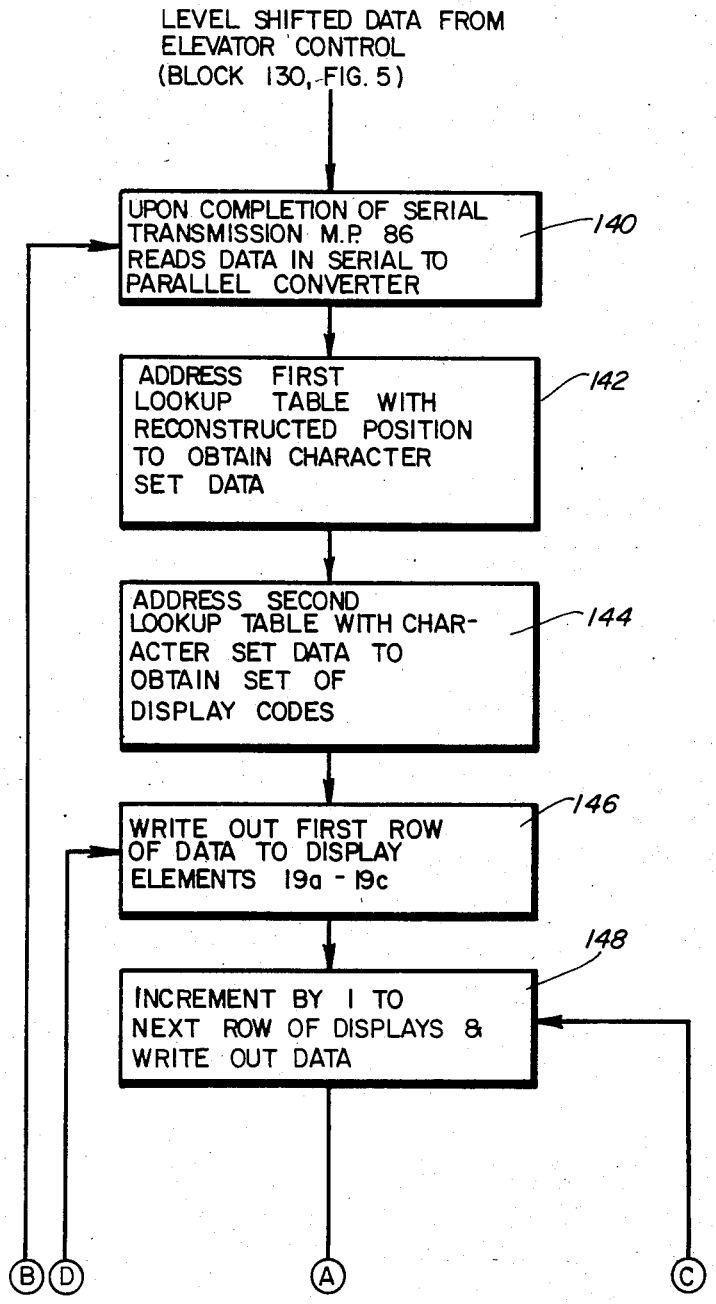
FIGS. 6A and 6B, when joined along similarly lettered lines, comprise a flow chart of a portion of the program executed by the position indicator microcomputer shown in FIG. 4A.
Figure 6B:
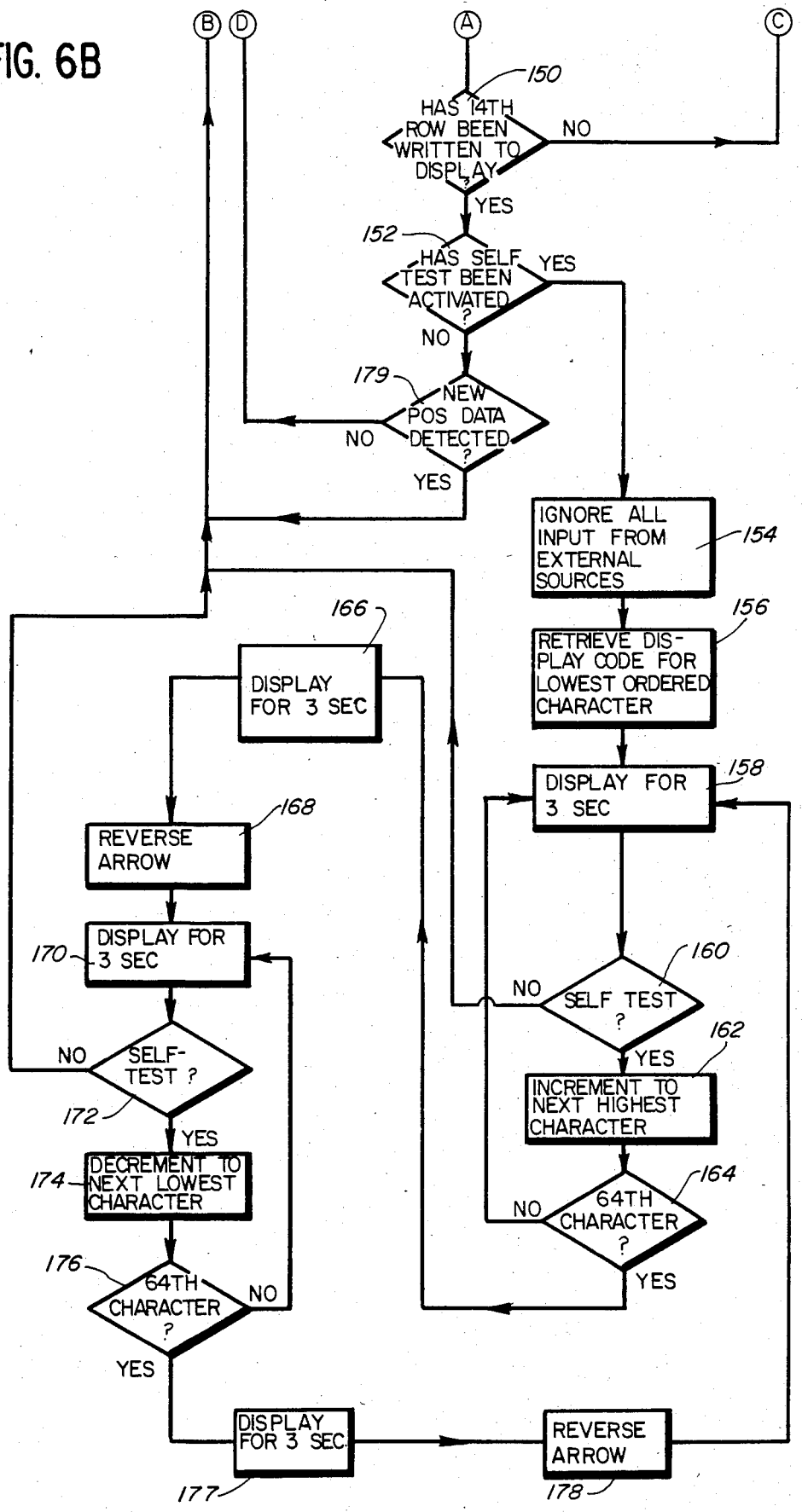

Referring now to FIGS. 6A and 6B, there is illustrated a flow chart representing a portion of the programming contained within the PROM 84 for the position indicator 70.

The clock pulses and the 8-bit word representing elevator position are optically isolated and level shifted down to approximately 5 volts DC by the optical isolators 75,76. These signals are then coupled through the buffers 77a,77b to the serial to parallel converter U1.

The converter U1 converts the serial information so as to reconstruct the 8-bit word. A block 140, FIG. 6A, reads the reconstructed word upon completion of the serial transmission process. The microprocessor 86 instructs the memory address decoder 102 to energize the output line DRD, in turn causing the buffers 104 to pass the information at the output of the serial to parallel converter U1 to the bus 78. The information is sent to the data input of the microprocessor 86 through the bus transceiver U2.

A block 142 then initiates a look up procedure by utilizing the data from the converter U1 as an address to a first look up table having a plurality of memory locations. The memory locations of the first look up table store a plurality of character codes which indicate which character set is to be displayed on the display elements 19a–19c. In other words, the first look up table interprets the 8-bit position data from the elevator control to determine what character set should be displayed, e.g. 14↑ to designate that the 14th floor has been reached and that the elevator is moving in an up direction.

In the preferred embodiment, the library of characters stored in the PROM 84 is capable of forming 64 character sets (i.e. $2^6$ character sets as allowed by the six bits of the 8-bit position word) plus an up and a down arrow. The standard library may be capable of forming the following character sets (where each character may be accompanied by an up or down or no arrow).

1-45
B, D, G, K, L, M,
P, R, S, B1, B2, SB,

-continued

| LL, UL, MM, P1, P2, P3 |
|---|

It should be noted that a different character library may be implemented by loading the PROM 84 with character and display codes in the look up tables which will form any letter or symbol as desired. Once this is accomplished, it is only necessary to suitably program the elevator control to generate the appropriate 8-bit position code to cause the position indicator to display the desired character set at the appropriate point in the elevator travel. In this fashion, one of various character sets may be displayed for a particular elevator position.

A block 144 then utilizes the data from the first table as the address to a second look up table which contains a second plurality of memory locations storing sets of display codes. In general, the addressing of the second look up table by a character code results in the generation of a set of display codes which contains the information necessary to energize the appropriate dots in each of the display elements to display the desired indication of position.

A block 146 then energizes the appropriate dots in the first row of each of the display elements 19*a*–19*c* in accordance with the set of display codes. This is accomplished by the display address decoder 110, FIG. 4B, which causes the latches 100*a*–100*i* to store the display codes, sent to them by the microprocessor 86 over bus 78, for the first row from the second look up table. Once this information is stored in the latches 100, the display address decoder 110 causes the row counter 106 to energize the grid circuit for the first row of each of the elements 19*a*–19*c* through the level shifters 108. Those dots of each display element 19 having its plate and grid circuits both energized to 40 volts DC will be energized according to the program code obtained from the second look up table.

A block 148 causes the display address decoder 110 to increment the row counter by one, clears the latches 100 and stores the information for the next row of the display in the latches 100. The information is then written out to the second row of the display in a fashion identical to that described above. A block 150, FIG. 6B, then determines whether the 14th row has been written out to the display, i.e. whether all of the rows have been displayed. If this is not the case, control returns to the block 148 where the next row is displayed. The display is energized row by row, i.e. multiplexed, at such a rapid rate that the characters appear to the human eye to be steadily illuminated.

If the block 150 determines that all of the rows have been displayed, then a block 152 determines whether a self-test function has been selected. The self-test function is used to check the operability of the system by causing each of the character sets stored in the PROM 84 to be displayed in sequential fashion in alternating ascending and descending order. The self-test function is selected by connecting a jumper 153, FIG. 4A, to a low voltage potential (i.e. to the position opposite to that shown in FIG. 4A). If the self-test function has been actuated, control passes to a block 154 which initiates the self-test routine. The block 154 causes the microprocessor 86 to ignore all inputs from external sources, i.e. lines PI1–PI3. A block 156 retrieves the entries in the first and second look up tables corresponding to the lowest ordered character set in the library (i.e. in the preferred embodiment, a blank with an up arrow is "displayed"). This code is then written out to the displays by a block 158 one row at a time as previously described. The display character set is maintained on the display for three seconds after which a block 160 determines whether the self-test function is still requested. If this is the case, a block 162 retrieves the set of display codes to display the next highest ordered character (i.e. "1" with an up arrow) and a block 164 determines whether this entry is the 64th entry in the first look up table. If this is not the case, control passes back to the block 158 to generate an indication of this character set on the display 19 for three seconds.

If the block 164 determines that the 64th character set has been retrieved, indicating that all of the character sets have been displayed with the exception of the last, control passes to a block 166 which displays the 64th character set (i.e. "P3" with an up arrow) for three seconds.

A block 168 reverses the direction of the arrow (i.e. from an up arrow to a down arrow) and a block 170 then displays the 64th character set for three seconds (i.e. "P3 ↓" is displayed).

A block 172 then determines whether the self-test function is still requested, and if this is the case, the set of display codes corresponding to the next lowest ordered character set is retrieved by a block 174. A block 176 then determines whether all of the character sets have been displayed in descending order except the last. If this is the case then a block 177 displays the character set for three seconds after which the arrow direction is reversed by a block 178. Control then returns to the block 158 to display the lowest ordered character set, i.e. blank with an up arrow, to re-initiate the display of the character sets in ascending order.

If the block 176 determines that not all of the character sets have been displayed in descending order, control passes back to the block 170 to continue this function.

If the block 152 determines that the self-test has not been activated, then control passes to a block 179 which determines whether new position data has been sent by the elevator control to the position indicator. If the position has not changed, the display is refreshed by passing control back to the block 146 which re-initiates the process of energizing the displays one row at a time.

Figure 7:
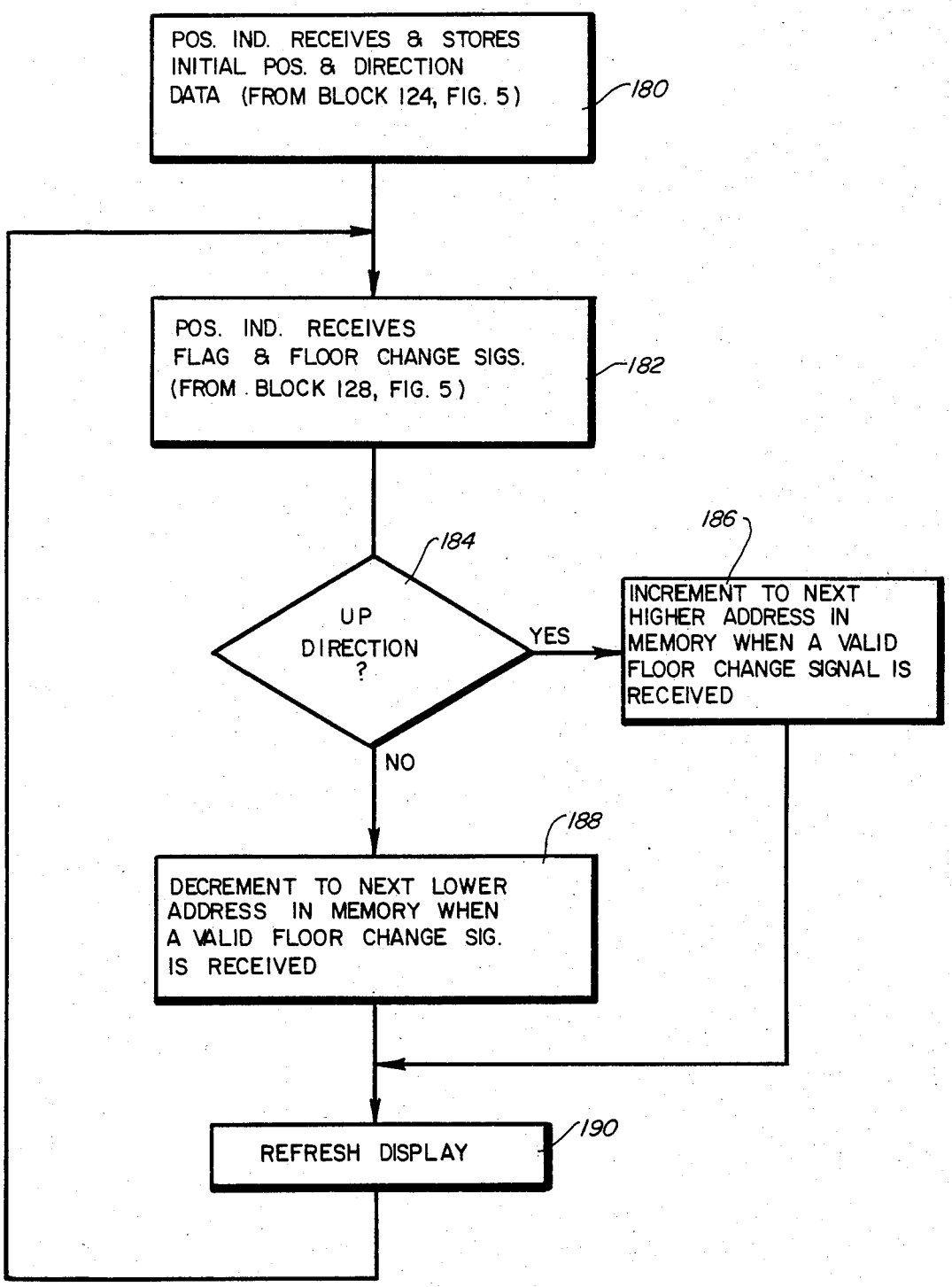
FIG. 7 is a flow chart of the remainder of the program executed by the position indicator microcomputer shown in FIG. 4A.

If the block 179 determines that new data has been received from the elevator control, control passes back to the block 140, FIG. 6A, which re-initiates the look up procedure through the first and second software tables.

referring now to FIG. 7, there is illustrated the programming which is stored in the PROM 84 of the position indicator 70 for the pulsed mode operation. A block 180 receives and stores the data representing the initial position and direction of movement of the elevator car 12 from the block 124 in FIG. 5. A block 182 senses the flag signal which is sent to the position indicator 70 over the line PI1 and the floor change pulses generated on the line PI2. The microprocessor 86 accomplishes this function by instructing the memory address decoder to enable the buffers 79*a*,79*b* via a signal developed on the line CRD of the decoder 102.

A block 184 analyzes the two most significant bits of the 8-bit word to determine whether the up or down direction of travel is requested. If the block 184 determines that the up direction is requested, then a block 186 retrieves from the first and second look up tables the character set and display codes for the next highest ordered character set when a valid floor change pulse is received. In other words, if the character set associated with floor 15 is currently being displayed with an up arrow, then when the next valid floor change pulse is received, the character set associated with the 16th floor will be displayed with an up arrow.

If the block 184 determines that the up direction is not requested, then a block 188 will retrieve the display codes for the next lowest ordered character set when the next valid floor change pulse is received.

Control from each of the blocks 186,188 passes to a block 190 which continuously refreshes the displays until the next clock pulse is received.

The pulsed operation mode is utilized to indicate elevator car position in high speed elevator installations where there may not be sufficient time to allow an 8-bit word representing elevator car position and direction to be serially transmitted to the position indicator 70. The pulsed mode, instead of transmitting unique 8-bit word for each change in elevator position, generates only a pulse when a change in floor occurs and hence can respond much faster than the previously described serial mode.

It should be noted that in the pulsed mode the manner in which the display elements 19*a*–19*c* are energized is identical to that described in blocks 146–150 wherein the rows are multiplexed at a rapid rate so that the images appear to be steady to the human eye.

It should be noted that it is possible to cause messages to be displayed on the display elements 19*a*–19*c* in response to other operating parameters of the elevator or in response to a condition within the building. For example, the position indicator and elevator control may be programmed to display a message "FS" for fire service when a fire is detected within the building. Or, the symbol "DO" may be displayed (representing "door open") when an object has interfered with closing of the elevator doors 16, thereby inhibiting movement of the elevator car.

It can be seen that the use of a standardized library allows the position indicator to be mass produced, with customization for each particular installation being effected by suitable programming of the elevator control only. Further, the position indicator affords greater flexibility, if desired, by utilizing other standard libraries which may be developed or by programming the position indicator and the elevator control to display other types of information, such as informational messages, operational warnings, diagrams or the like.

What is claimed is:

1. In an elevator system having an elevator control for controlling the movement of an elevator car and means for sensing the position of the elevator car, a position indicating system comprising:

a display;

means for actuating the display to generate an indication of a character in response to display codes;

a memory having memory locations storing a plurality of sets of display codes and further including first and second look up tables;

means in the elevator control associated with the sensing means for generating a multi-bit word representing elevator position;

means for serially transmitting the multi-bit word to the position indicator including clock and data lines connected between the elevator control and the position indicator wherein the multi-bit word is transmitted one bit at a time over the data line simultaneously with the clock pulse over the clock line;

a serial to parallel converter coupled to the data and clock lines for reconstructing the multi-bit word at a multi-bit output of the converter; and means for accessing the memory in accordance with the multi-bit word such that a particular character is indicated by the display for a particular sensed elevator car position wherein the first look up table is addressed by the reconstructed multi-bit word and generates a character code representing the character to be displayed and wherein the second look up table is addressed by the character code to generate a set of display codes.

2. The position indicating system of claim 1, wherein the display comprises a plurality of display elements.

3. The position indicating system of claim 2, wherein each display element includes individually energizable dots arranged in rows.

4. The position indicating system of claim 3, wherein the dots of each display element are selectively energized in accordance with the set of display codes one row at a time.

5. The position indicating system of claim 1, further including means for selecting a test routine wherein a series of characters are sequentially displayed regardless of position of the elevator car.

6. In an elevator system having an elevator control for controlling the movement of an elevator car wherein the elevator car assumes a plurality of discrete positions and means for sensing the position of the elevator car, a position indicating system comprising:

a display;

means for actuating the display to generate an indication of a character in response to display codes;

a memory having memory locations storing a standard library of sets of display codes;

means in the elevator control associated with the sensing means for generating a multi-bit word representing elevator position;

means for serially transmitting the multi-bit word to the position indicator;

a processor in the position indicator for accessing the memory in accordance with the multi-bit word such that a particular character is indicated by the display for a particular sensed elevator car position; and means for operating the display in a pulsed mode of operation including means for storing the multi-bit word representing an initial position and desired direction of travel of the elevator car, means in the elevator control for generating a pulse each time the elevator car changes position and means responsive to each pulse for retrieving from the memory a set of display codes selected in accordance with the initial position and desired direction of travel of the elevator car.

7. The position indicating system of claim 6, wherein each position of the elevator car is associated with a unique set of display codes so that a unique character is indicated for each position of the elevator car, and wherein the retrieving means includes means for obtaining from the memory the display codes necessary to indicate the character corresponding to the next position of the elevator car when a clock pulse is generated.

8. In an elevator system having an elevator control for controlling the movement of an elevator car along discrete positions comprising the floors of a building and means for sensing the position of the elevator car, a position indicating system comprising:

a position indicator;

means in the elevator control associated with the sensing means for generating a multi-bit word representing elevator position; and means for serially transmitting the multi-bit word to the position indicator;

wherein the position indicator includes a serial to parallel converter for reconstructing the multi-bit word, a memory having first and second look up tables stored therein, the first look up table having a first plurality of memory locations each of which stores a character code and the second look up table having a second plurality of memory locations, each of which stores a set of display codes, means for accessing the first memory with the reconstructed multi-bit word to retrieve a particular character code, means for accessing the second memory with the particular character code to retrieve a particular set of display codes, a display having three display elements each of which comprises a series of individually energizable dots; and means for selectively energizing the dots of each display element in accordance with the particular set of display codes such that a particular character is indicated by each display element for a particular sensed elevator car position.

9. The position indicating system of claim 8, wherein the transmitting means includes means for developing clock pulses and clock and data lines coupled to the serial to parallel converter for transmitting one bit of the multi-bit word simultaneously with each clock pulse.

10. The position indicating system of claim 8, wherein the dots of each display element are arranged in rows and wherein the selective energizing means includes means for selectively energizing the dots one row at a time.

11. The position indicating system of claim 8, wherein for each position of the elevator car there is associated a unique character and wherein the elevator car travels in two directions, and further including means for operating the position indicator in a pulsed mode including:

means for storing the multi-bit word associated with an initial position and direction of travel of the elevator;

means in the elevator control for generating a pulse each time the elevator car changes position; and means for indicating on the display the character corresponding to the next position in the direction of movement of the elevator car upon the generation of each pulse.

12. The position indicating system of claim 8, further including means for selecting a test routine wherein a series of characters are sequentially displayed regardless of position of the elevator car.

13. The position indicating system of claim 12, wherein the memory stores a number of sets of display codes to generate an indication of a number of characters and wherein the selecting means includes means for recalling the display codes in a sequence such that the characters are displayed first in a particular order and then in an order opposite to the particular order.

* * * * *